US010764686B2

(12) United States Patent
Zhang

(10) Patent No.: US 10,764,686 B2
(45) Date of Patent: Sep. 1, 2020

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,070

(22) Filed: Jul. 28, 2019

(65) Prior Publication Data

US 2020/0045431 A1 Feb. 6, 2020

(30) Foreign Application Priority Data

Aug. 5, 2018 (CN) ..... 2018 2 1255029 U

(51) Int. Cl.
*H04R 7/20* (2006.01)
*H04R 9/02* (2006.01)

(52) U.S. Cl.
CPC ..... *H04R 7/20* (2013.01); *H04R 9/025* (2013.01)

(58) Field of Classification Search
CPC ..... H04R 9/06; H04R 9/025; H04R 9/043; H04R 9/04; H04R 1/06; H04R 2499/11; H04R 31/006; H04R 9/02; H04R 1/00; H04R 1/021; H04R 1/023
USPC ..... 381/397, 398, 396, 400, 408, 401, 433, 381/354, 410, 412, 420
See application file for complete search history.

(56) References Cited

U.S. PATENT DOCUMENTS

2011/0293133 A1* 12/2011 Yan ..... H04R 9/063 381/401
2013/0016874 A1* 1/2013 Huang ..... H04R 9/043 381/433
2015/0189442 A1* 7/2015 Zhang ..... H04R 9/025 381/409

* cited by examiner

*Primary Examiner* — Fan S Tsang
*Assistant Examiner* — Julie X Dang
(74) *Attorney, Agent, or Firm* — W&G Law Group LLP

(57) ABSTRACT

Provided is a speaker, including a holder, a vibration unit and a magnetic circuit unit fixedly held at the holder, and a bayonet portion penetrating through the holder. The vibration unit includes a diaphragm, a voice coil located at a side of the diaphragm and driving the diaphragm to vibrate and emit sound, and a flexible printed circuit board located at a side of the voice coil facing away from the diaphragm and connected to the voice coil. The flexible printed circuit board includes a body portion supporting the voice coil, an extension portion extending from body portion towards bayonet portion and passing through the bayonet portion, and a connecting portion bent and extending from a distal end of the extension portion along an outer side of the holder. The connecting portion is fitted to outer side of holder and used for electrical connection with an external circuit.

14 Claims, 6 Drawing Sheets

SPEAKER

TECHNICAL FIELD

The present disclosure relates to the field of acoustic-electrical conversion, and in particular, to a speaker used in portable electronic products.

BACKGROUND

With the rapid development of technologies, audio devices become more and more popular, and among numerous recreation modes, high-quality music enjoyment is gradually popularized. Thus, speakers for playing audio have been greatly applied to existing smart mobile devices.

The speaker in the related art includes a holder and a vibration unit and a magnetic circuit unit that are received in the holder. The vibration unit includes a diaphragm, a voice coil located below the diaphragm and used for driving the diaphragm to vibrate and emit sound, and a flexible printed circuit board located below the voice coil.

However, in the speaker in the related art, it is often necessary to additionally design an external pad structure for connecting the flexible printed circuit board with an external electrical device, which wastes the internal space of the speaker while increasing the difficulty in designing the internal structure of the speaker. Furthermore, the flexible printed circuit board and the holder are fixed only by glue, so that the connection of the flexible printed circuit board is not stable enough.

Therefore, it is necessary to provide a new speaker to overcome the above drawbacks.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
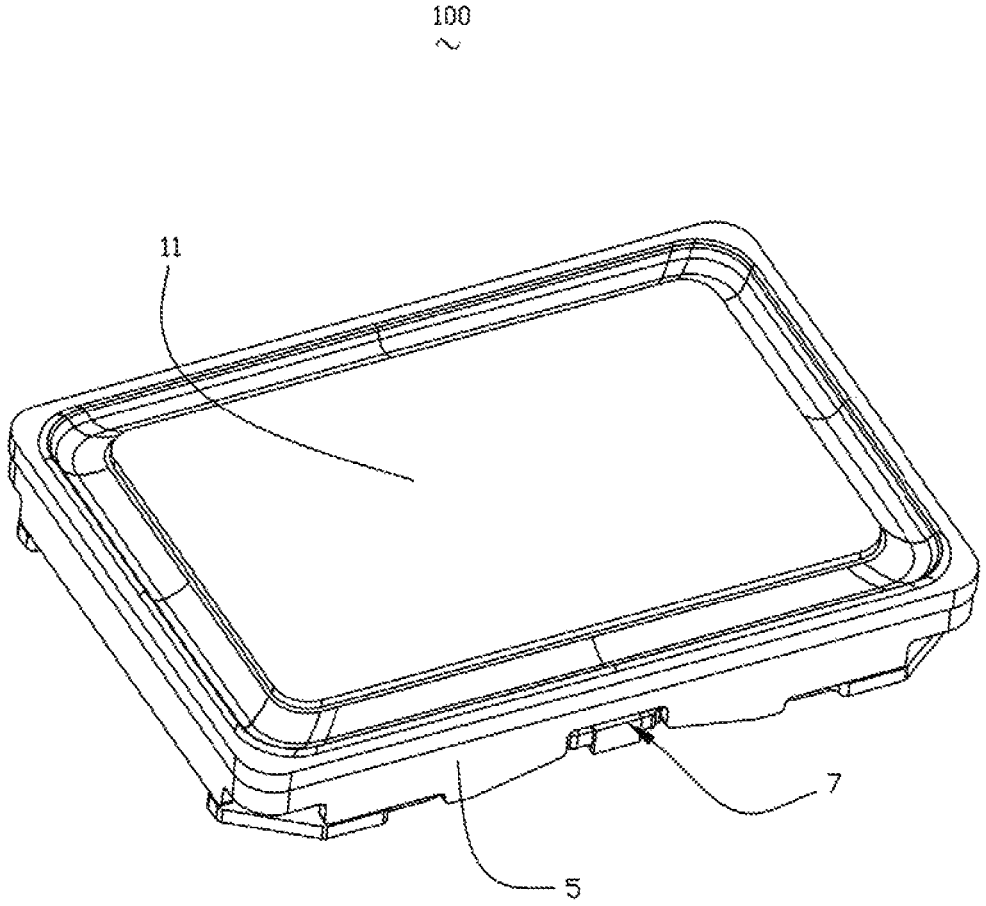
FIG. 1 is a perspective structural schematic diagram of a speaker of the present disclosure.
Figure 2:
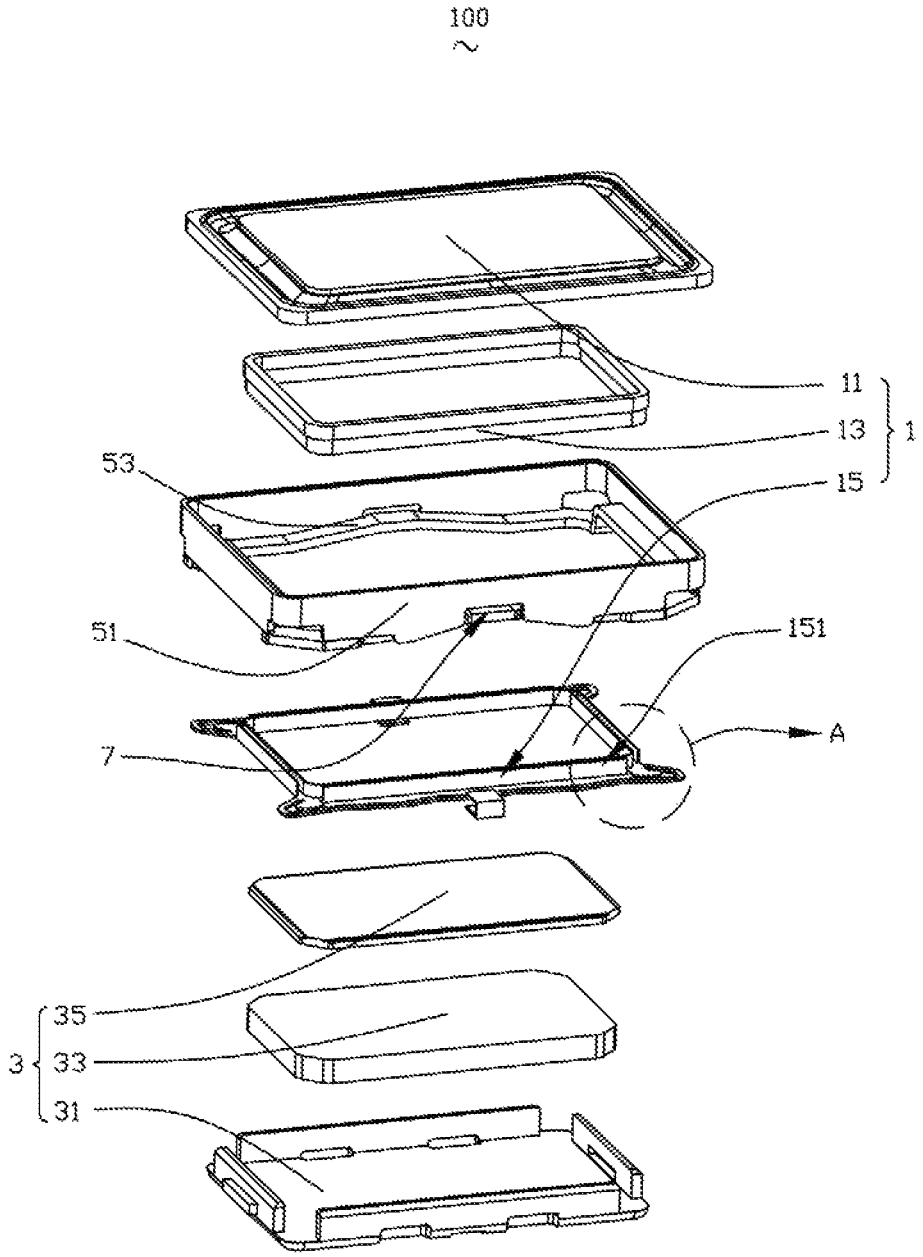
FIG. 2 is an exploded perspective structural schematic diagram of the speaker shown in FIG. 1.
Figure 3:
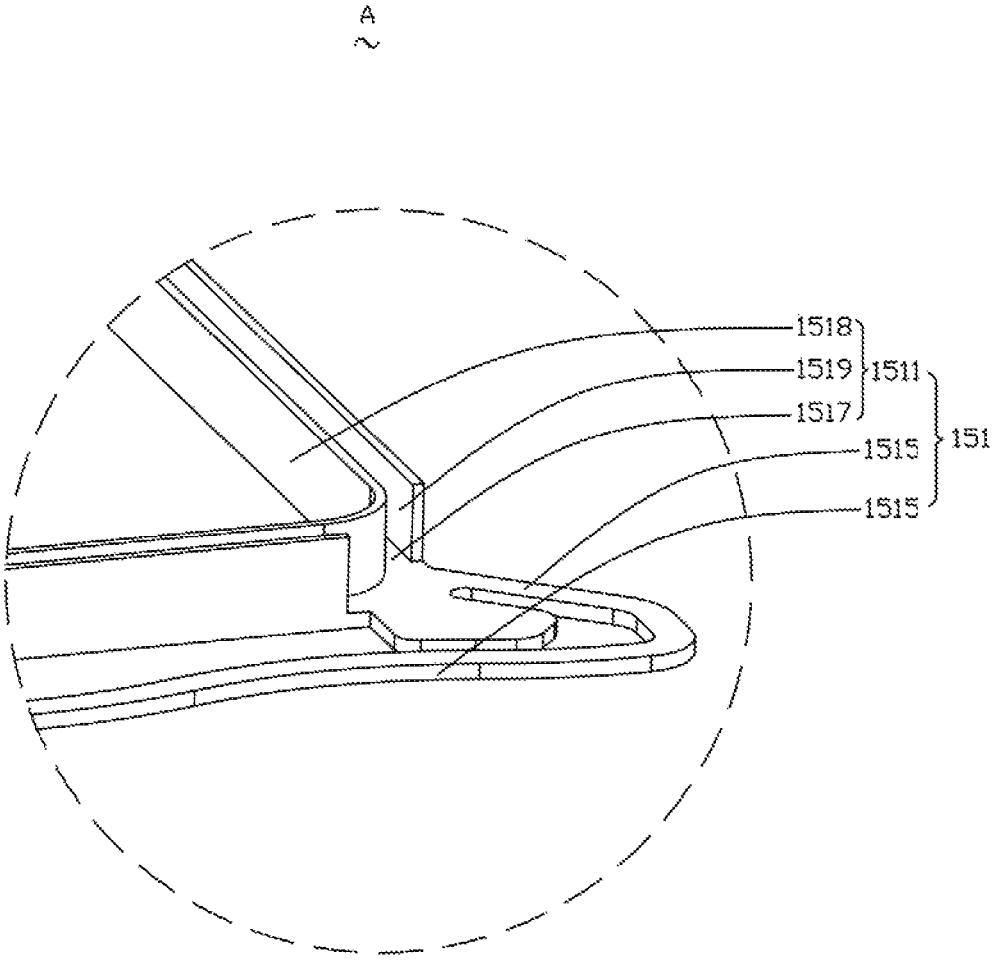
FIG. 3 is an enlarged diagram of a region A of the speaker shown in FIG. 2.
Figure 4:
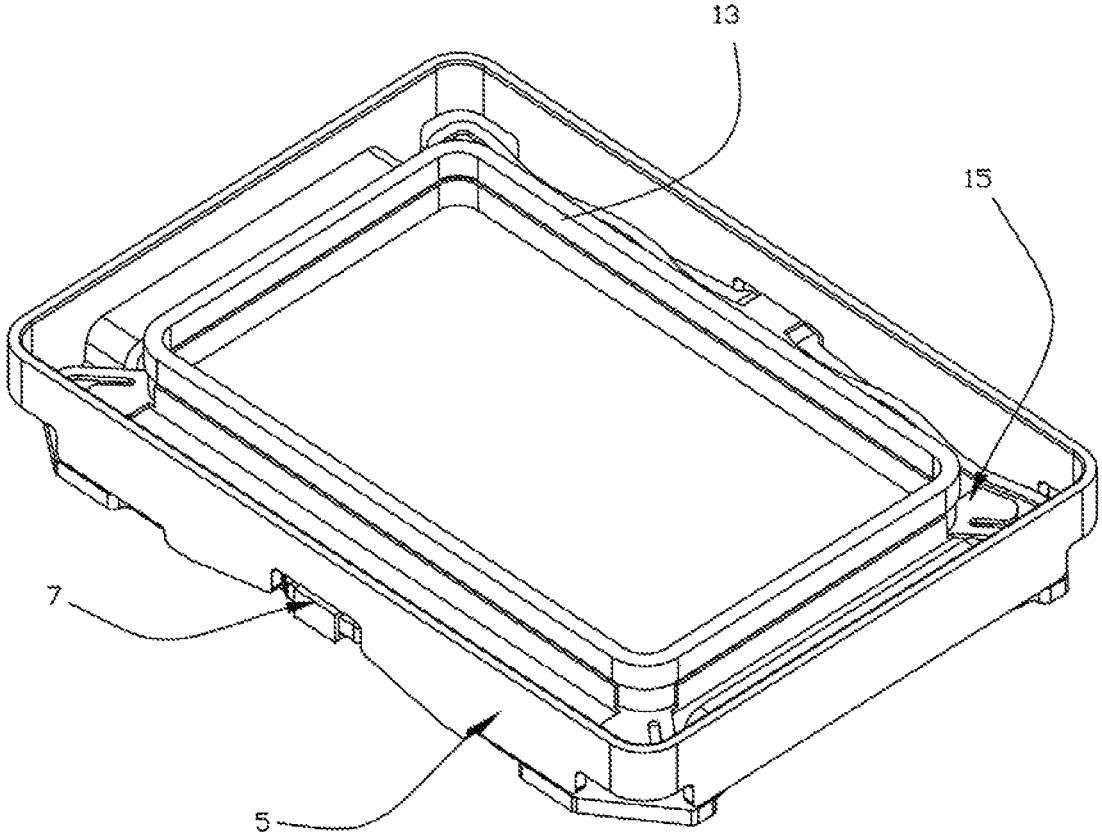
FIG. 4 is a partial perspective structural schematic diagram of a speaker of the present disclosure.
Figure 5:
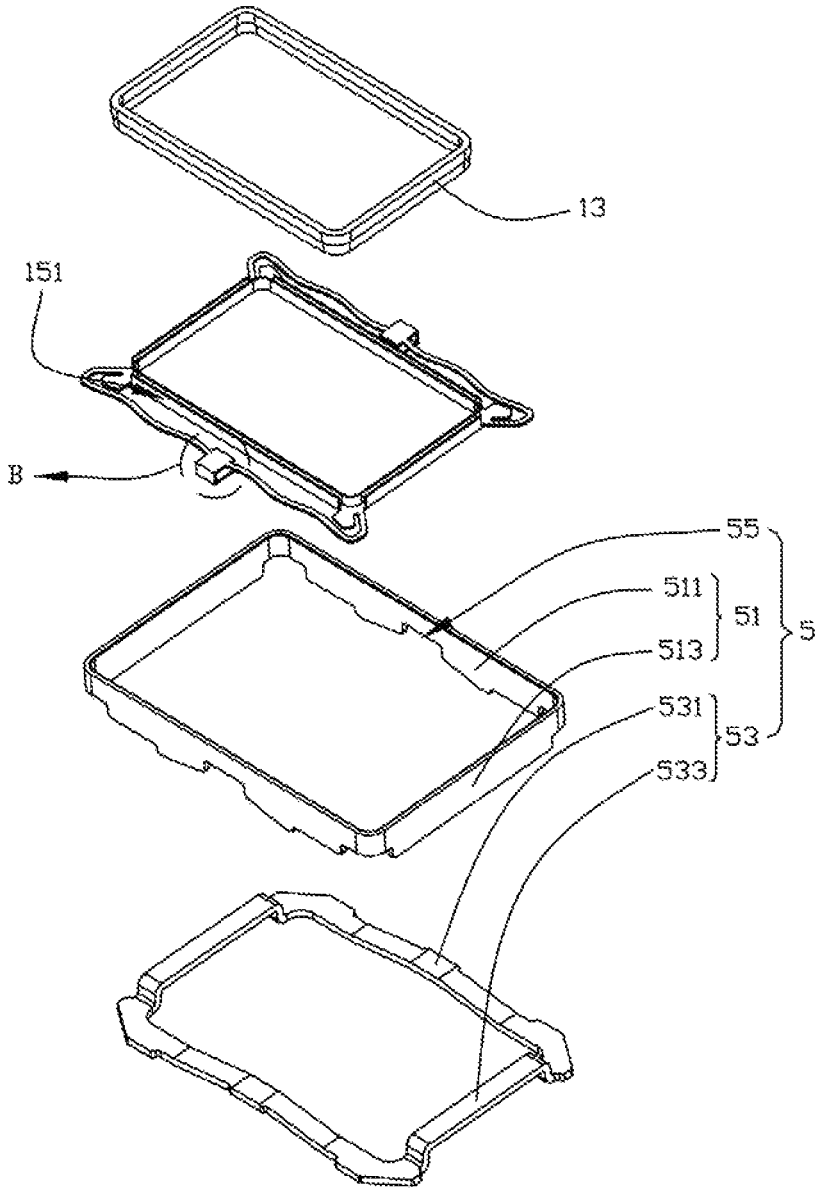
FIG. 5 is an exploded perspective structural schematic diagram of the speaker shown in FIG. 4.
Figure 6:
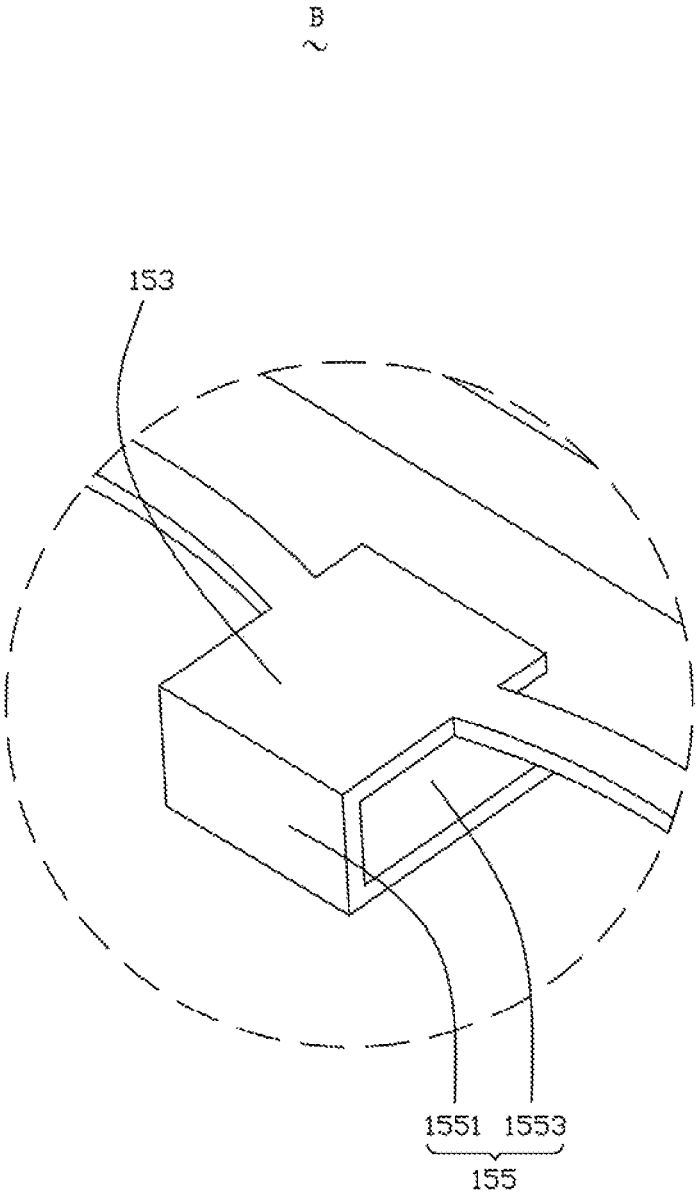
FIG. 6 is an enlarged diagram of a region B of the speaker shown in FIG. 5.

Referring to FIG. 1 to FIG. 6 in conjunction, the speaker 100 includes a vibration unit 1, a magnetic circuit unit 3, a holder 5 for receiving the vibration unit 1 and the magnetic circuit unit 3, and a bayonet portion 7 penetrating through the holder 5.

The vibration unit 1 includes a diaphragm 11, a voice coil 13 located at a side of the diaphragm 11 and driving the diaphragm 11 to vibrate and emit sound, and a flexible printed circuit board 15 located at a side of the voice coil 13 facing away from the diaphragm and connected to the voice coil 13.

The flexible printed circuit board 15 includes a body portion 151 that supports the voice coil 13, an extension portion 153 extending from the body portion 151 towards the bayonet portion 7 and passing through the bayonet portion 7, and a connecting portion 155 that is bent and extends from a distal end of the extension portion 153 along an outer side of the holder 5. The connecting portion 155 is fitted to the outer side of the holder 5 and used for electrical connection with an external circuit.

The body portion 151, in one aspect, supports the voice coil 13, and in another aspect, is electrically connected to the voice coil 13 for transmitting an external electrical signal to the voice coil 13. Specifically, the body portion 151 includes a fixing portion 1511 that is fixedly connected to the voice coil 13 and has a ring shape, an elastic arm 1513 spaced apart from the fixing portion 1511, and extension arms 1515 respectively extending from the elastic arm 1513 towards the fixing portion 1511 along two opposite ends at a side of the voice coil 13. The elastic arm 1513, the extension arms 1515 and the fixing portion 1511 form a ring. The connecting portion 155 is formed at the elastic arm 1513.

The fixing portion 1511 includes a support plate 1517 facing right towards the diaphragm 11, an inner side-plate 1518 extending from a side of the support plate 1517 facing away from the elastic arm 1513 while being bent towards the diaphragm 11, and an outer side-plate 1519 extending from a side of the support plate 1517 close to the elastic arm 1513 while being bent towards the diaphragm 11. The support plate 1517 has a ring shape, and the voice coil 13 is sandwiched between the inner side-plate 1518 and the outer side-plate 1519.

Specifically, the outer side-plate is provided with an avoiding notch corresponding to the extension wall 1515.

The extension portion 153 and the connecting portion 155 together enclose a buckle structure having a U-shaped cross section, and the connection strength between the flexible printed circuit board 15 and the holder 5 is increased by providing the buckle structure. Moreover, by providing the connecting portion 155, the flexible printed circuit board 15 can be directly connected to an external electrical device without providing an external pad additionally, thereby saving internal space of the speaker 100.

The connecting portion 155 is formed a middle position of the elastic arm 1513. Specifically, the connecting portion 155 includes a transition portion 1551 extending along the outer side of the holder 5 towards the direction facing away from the diaphragm 11, and a pad portion 1553 that is bent and extends from an end of the transition portion 1551 facing away from the body portion 151 along the surface of the holder 5 facing away from the diaphragm 11. The pad portion 1553 is arranged opposite to the extension portion 153 and fixedly connected to the surface of the holder 5 facing away from the diaphragm 11.

The pad portion 1553 is used for connection with an external circuit.

The magnetic circuit unit 3 includes a yoke 31 provided at an end of the holder 5 facing away from the diaphragm 11, a magnet 33 assembled in the center of the yoke 31, and a pole plate 35 assembled above the magnet 33.

The holder 5 may be a metal holder. The holder 5 includes a frame body 51 connected to the diaphragm 11, a support edge 53 provided at an end of the frame body 51 facing away from the diaphragm 11 and connected to the frame body 51, and a recessed portion 55 formed by recessing from a surface of the frame body 51 facing away from the diaphragm 11 towards the diaphragm 11. The support edge 53 and the recessed portion 55 cooperate to form the bayonet portion 7.

In this embodiment, the frame body 51 and the support edge 53 are separately formed. Of course, this is not a limitation to the present disclosure. In other embodiments, the frame body 51 and the support edge 53 may also be integrally formed.

The frame body 51 includes two first sidewalls 511 arranged opposite to each other and two second sidewalls 513 arranged opposite to each other. The two first sidewalls 511 and the two second sidewalls 513 are connected end to end to form a rectangular frame shape. A length of the first sidewall 511 is greater than that of the second sidewall 513. In this embodiment, the recessed portion 55 is provided at a middle position of the first sidewall 511.

The support edge 53 includes two first support edges 531 respectively connected to the two first sidewalls 511 and two second support edges 533 respectively connected to the two second sidewalls 513. The first support edge 531 is fixedly connected to the elastic arm 1513 and the extension arm 1515 by glue. Moreover, the first support edge 531 is buckled in a buckle structure enclosed by the extension portion 153 and the connecting portion 155, so as to enhance stability of the connection between the flexible printed circuit board 15 and the holder 5.

Specifically, the first support edge 531 includes a lower surface facing away from the diaphragm 11, an upper surface arranged opposite to the lower surface, and a side surface connecting the upper surface with the lower surface. The extension portion 153 is connected to the upper surface. The transition portion 1551 is connected to the side surface, and the pad portion 1553 is connected to the lower surface.

It should be noted that, in the speaker 100 provided by the present disclosure, the number of the bayonet portions 7 is not limited but can be set according to actual needs. In the present embodiment, the number of the bayonet portions 7 is two. Correspondingly, the number of the recessed portions 55 is also two, and these two recessed portions are respectively provided one the two first sidewalls 511. The two recessed portions 55 and the two first support edges 531 are assembled to form the two bayonet portions 7. Moreover, correspondingly, the number of the extension portions 153 and the number of the connecting portions 155 are also two.

Compared with the related art, by providing the extension portion 153 and the connecting portion 155 on the flexible printed circuit board 15 in such a manner that the extension portion 153 and the connecting portion 155 together enclose a buckle structure having a U-shaped cross section, the speaker 100 provided by the present disclosure strengthens the fixing connection between the flexible printed circuit board 15 and the holder 5, and the stability of the speaker 100 is increased. Moreover, the pad portion 1553 connected to the voice coil 13 via the transition portion 1551, the extension portion 153 and the body portion 151 is provided, so that the voice coil 13 can be directly connected to an external electrical device via the flexible printed circuit board 15 without providing an external pad additionally, thereby saving internal space of the speaker 100.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A speaker, comprising:

a holder;

a vibration unit fixedly held at the holder, the vibration unit comprising: a diaphragm; a voice coil located at a side of the diaphragm and configured to drive the diaphragm to vibrate and emit sound; and a flexible printed circuit board located at a side of the voice coil facing away from the diaphragm and connected to the voice coil;

a magnetic circuit unit fixedly held at the holder; and a bayonet portion penetrating through the holder, wherein the flexible printed circuit board comprises:

a body portion that supports the voice coil;

an extension portion extending from the body portion towards the bayonet portion and passing through the bayonet portion; and a connecting portion that is bent and extends from a distal end of the extension portion along an outer side of the holder, wherein the connecting portion is fitted to the outer side of the holder and used for electrical connection with an external circuit.

2. The speaker as described in claim 1, wherein the holder comprises:

a frame body connected to the diaphragm; and a support edge provided at an end of the frame body facing away from the diaphragm and connected to the frame body, wherein the bayonet portion is formed on the frame body.

3. The speaker as described in claim 2, wherein the connecting portion comprises:

a transition portion extending along the outer side of the holder in a direction facing away from the diaphragm; and a pad portion that is bent and extends from an end of the transition portion facing away from the body portion along a surface of the support edge facing away from the diaphragm, the pad portion being arranged opposite to the extension portion and fixedly connected to the surface of the support edge facing away from the diaphragm, the pad portion being used for connection with an external circuit.

4. The speaker as described in claim 3, wherein the frame body and the support edge are separately formed, a recessed portion is formed by recessing from a surface of the frame body facing away from the diaphragm towards the diaphragm, and the support edge and the recessed portion cooperate to form the bayonet portion.

5. The speaker as described in claim 4, wherein the frame body is formed by two first sidewalls arranged opposite to each other and two second sidewalls arranged opposite to each other, the two first sidewalls and the two second sidewalls are connected end to end to form the frame body, each of the two first sidewalls has a length greater than each of the two second sidewalls, and the recessed portion is provided on each of the first sidewalls.

6. The speaker as described in claim 5, wherein the support edge comprises two first support edges respectively connected to the two first sidewalls and two second support edges respectively connected to the two second sidewalls, each of the two first support edges being buckled in a buckle structure formed by the extension portion and the connecting portion.

7. The speaker as described in claim 6, wherein each of the two first support edges comprises a lower surface facing away from the diaphragm, an upper surface arranged opposite to the lower surface, and a side surface connecting the upper surface with the lower surface, the extension portion being connected to the upper surface, the transition portion being connected to the side surface, and the pad portion being connected to the lower surface.

8. The speaker as described in claim 6, wherein there are two recessed portions respectively provided on the two first sidewalls, the two recessed portions and the two first support edges cooperate to enclose the two bayonet portions, and there are two extension portions and two connecting portions correspondingly.

9. The speaker as described in claim 8, wherein each of the two recessed portions is provided at a middle position of one of the two first sidewalls.

10. The speaker as described in claim 1, wherein the body portion comprises:

a fixing portion that is fixedly connected to the voice coil and has a ring shape;

an elastic arm spaced apart from the fixing portion; and extension arms respectively extending from the elastic arm towards the fixing portion along two opposite ends at a side of the voice coil, wherein the elastic arm, the extension arms and the fixing portion form a ring, and the connecting portion is formed at the elastic arm.

11. The speaker as described in claim 10, wherein the connecting portion is formed at a middle position of the elastic arm.

12. The speaker as described in claim 10, wherein the fixing portion comprises:

a support plate facing right towards the diaphragm;

an inner side-plate extending from a side of the support plate facing away from the elastic arm while being bent towards the diaphragm; and an outer side-plate extending from a side of the support plate close to the elastic arm while being bent towards the diaphragm, wherein the support plate has a ring shape, and the voice coil is sandwiched between the inner side-plate and the outer side-plate.

13. The speaker as described in claim 12, wherein the outer side-plate is provided with an avoiding notch corresponding to the extension arms.

14. The speaker as described in claim 1, wherein the holder is a metal holder.

* * * * *